US006930662B2

(12) United States Patent
Aoki

(10) Patent No.: US 6,930,662 B2
(45) Date of Patent: Aug. 16, 2005

(54) LIQUID CRYSTAL DISPLAY APPARATUS, IMAGE SIGNAL CORRECTION CIRCUIT, AND ELECTRONIC APPARATUS

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 323 days.

(21) Appl. No.: 09/969,640

(22) Filed: Oct. 4, 2001

(65) Prior Publication Data

US 2002/0044123 A1 Apr. 18, 2002

(30) Foreign Application Priority Data

Oct. 4, 2000 (JP) ..... 2000-304980

(51) Int. Cl.[7] ..... G09G 3/36

(52) U.S. Cl. ..... 345/87; 345/98; 345/213; 345/690

(58) Field of Search ..... 345/87, 92, 98–100, 345/211–213, 690

(56) References Cited

U.S. PATENT DOCUMENTS 5,422,680 A * 6/1995 Lagoni et al. ..... 348/674
6,002,810 A * 12/1999 Wakisawa et al. ..... 382/298
6,166,720 A * 12/2000 Sim ..... 345/154
6,297,815 B1 * 10/2001 Byun ..... 345/212
6,369,825 B1 * 4/2002 Nakano ..... 345/562
6,433,764 B1 * 8/2002 Hebiguchi et al. ..... 345/87
6,661,400 B2 * 12/2003 Sakashita ..... 345/89

FOREIGN PATENT DOCUMENTS

JP 11-119743 4/1999

* cited by examiner

*Primary Examiner*—Alexander Eisen
*Assistant Examiner*—Kimnhung Nguyen
(74) *Attorney, Agent, or Firm*—Oliff & Berridge, PLC

(57) ABSTRACT

A subtractor obtains a difference between an image signal, which is supplied in accordance with horizontal scanning and vertical scanning, and which carries information corresponding to a gray level of a pixel and a reference signal Ref representing a predetermined gray level. The result is integrated by an integrator on a horizontal scanning basis, multiplied with an appropriate coefficient, generating a correction signal Igr, which simulates the voltage variation of an opposing electrode, a capacitor line, etc. The correction signal Igr is added to the original image signal VID, and a corrected image signal VID' is supplied to a liquid crystal panel. Thus, a voltage to which the voltage variation of the opposing electrode is added is applied to a pixel electrode, canceling the voltage variation of the opposing electrode, preventing degradation of the display quality due to horizontal crosstalk.

10 Claims, 11 Drawing Sheets

[FIG. 1]
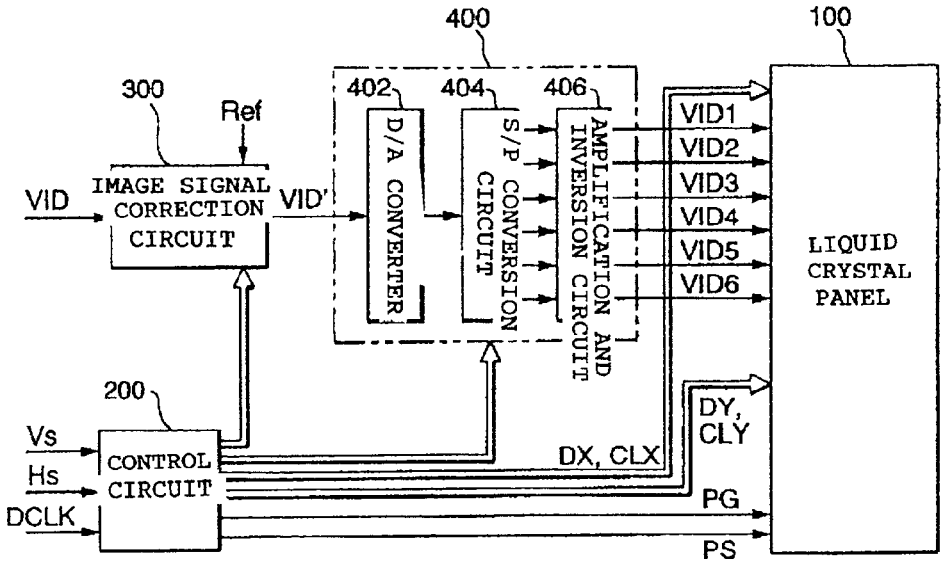

[FIG. 2]
(a)
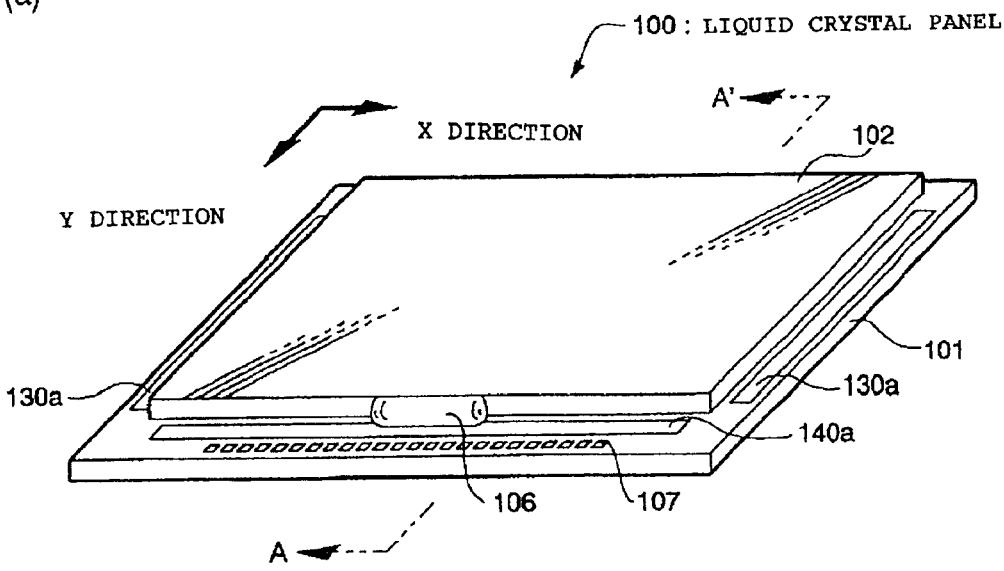
(b)
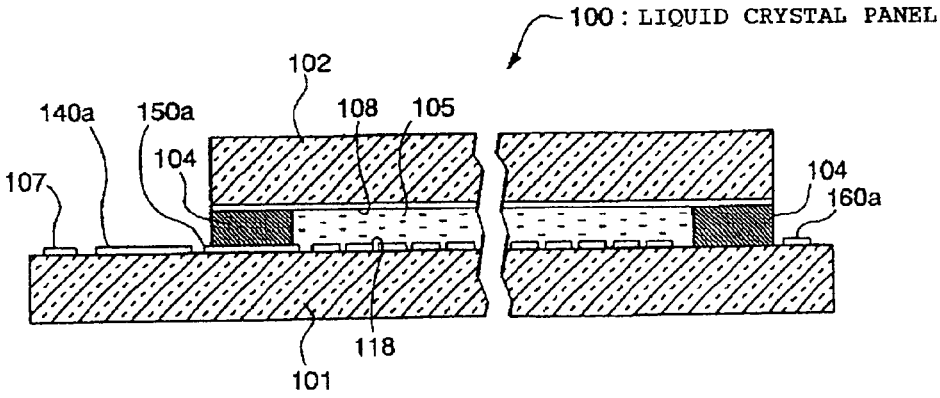

[FIG. 3]
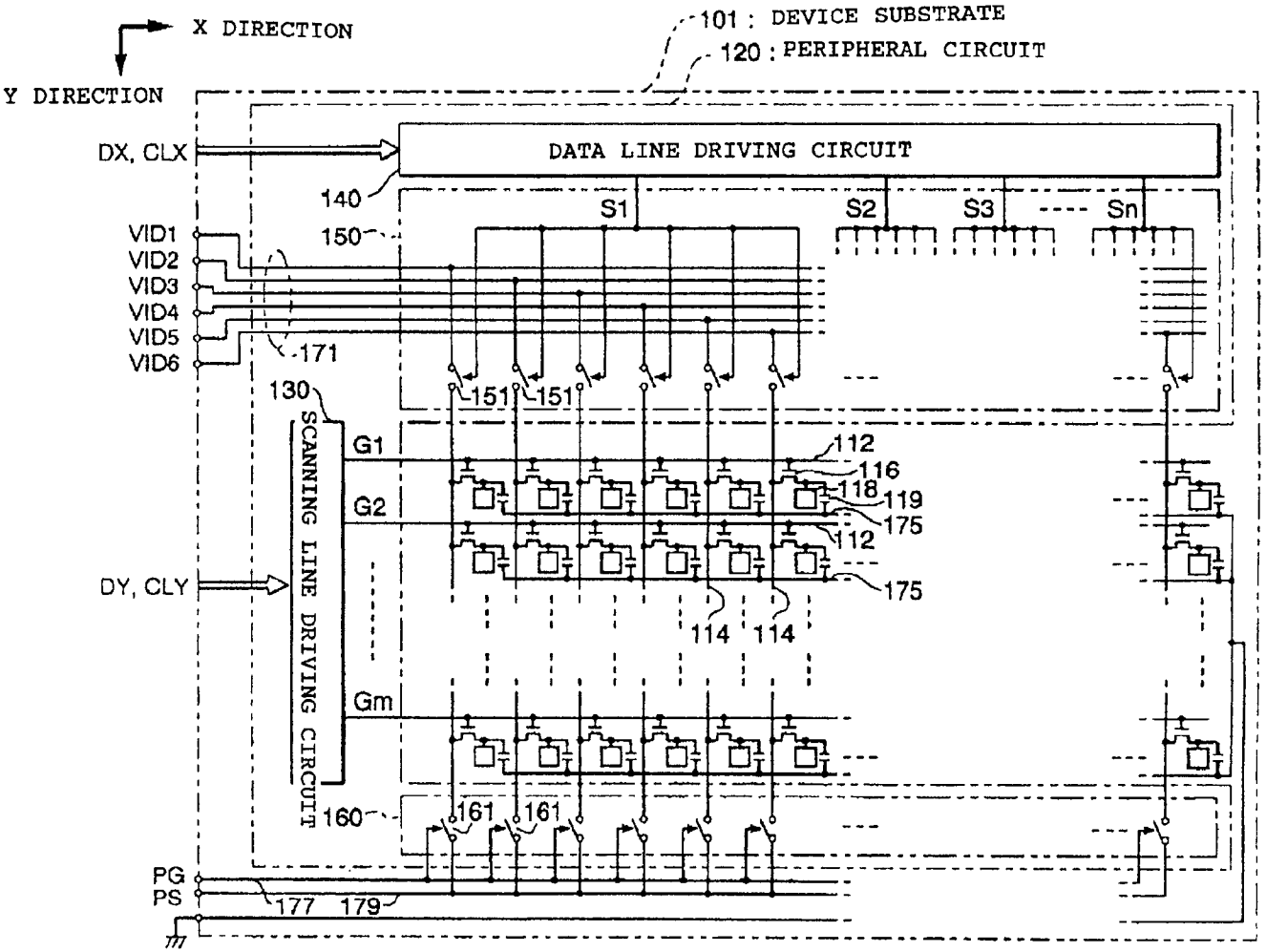

[FIG. 4]
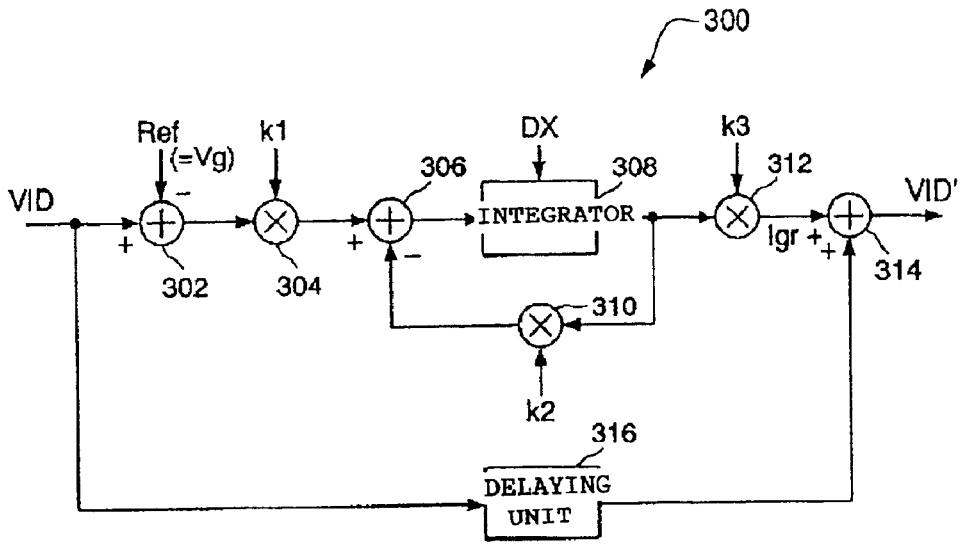

[FIG. 5]
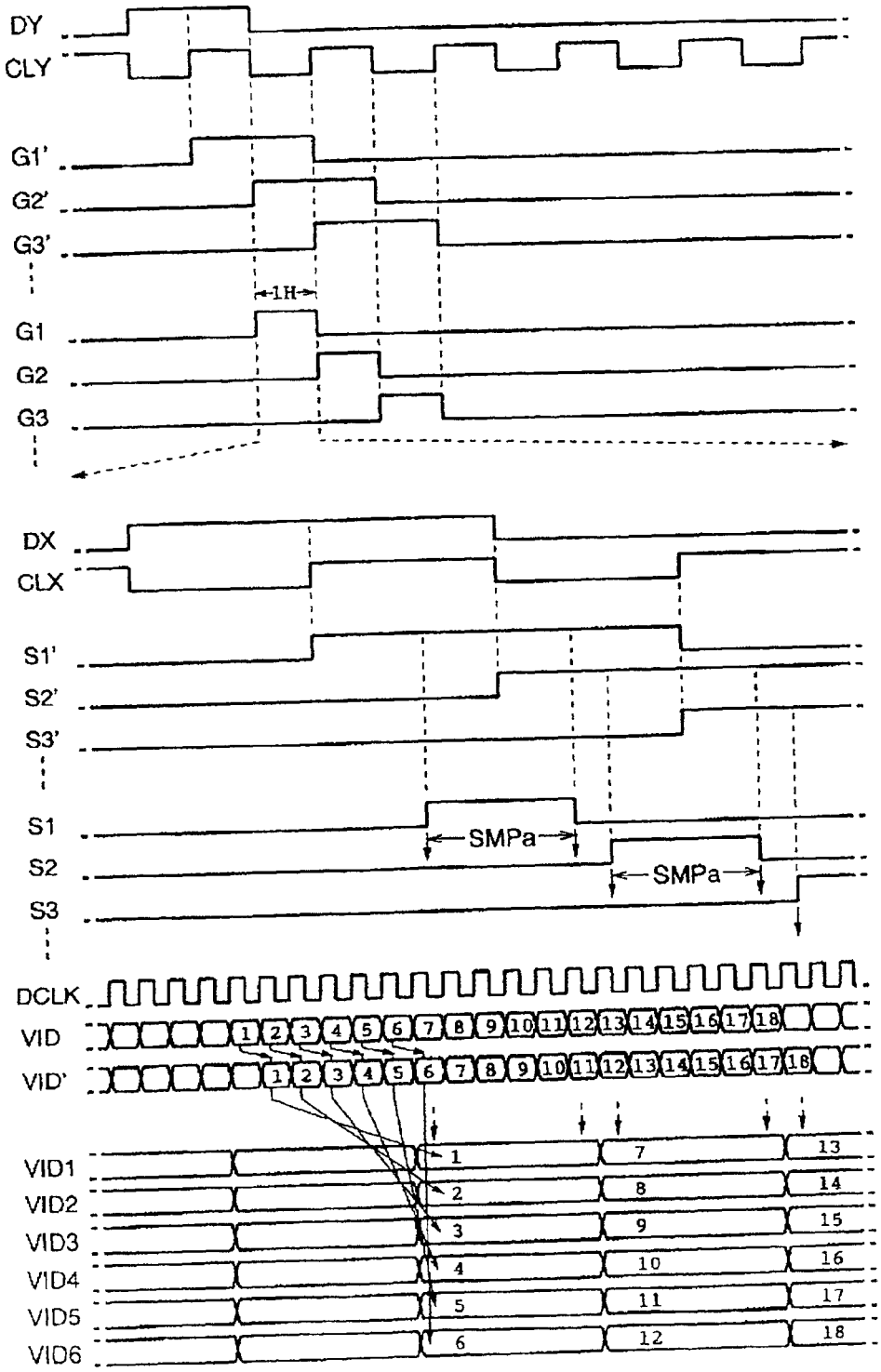

[FIG. 6]
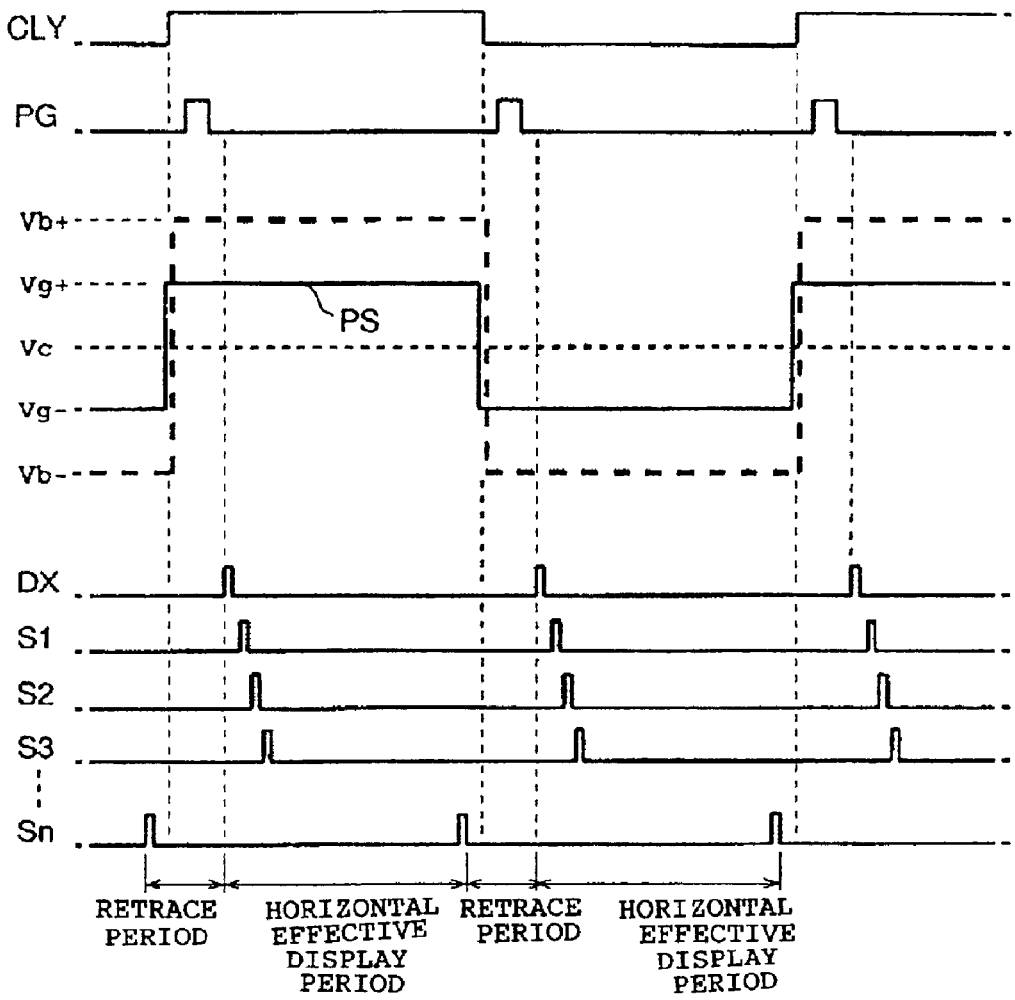

[FIG. 7]
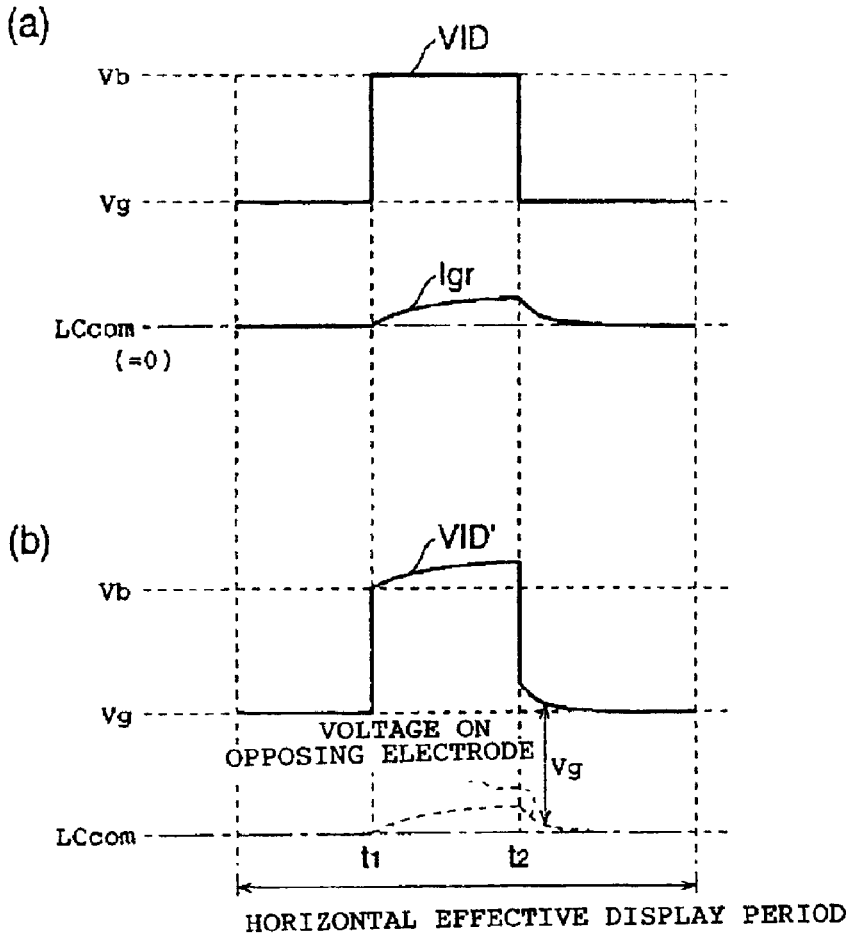

[FIG. 8]
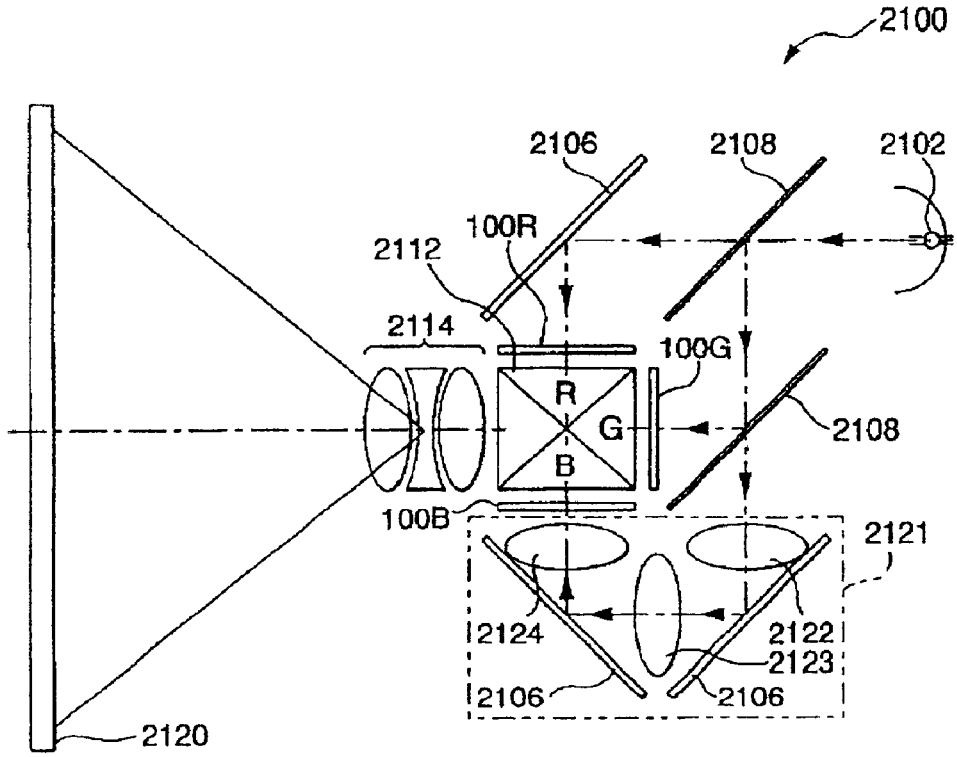

[FIG. 9]
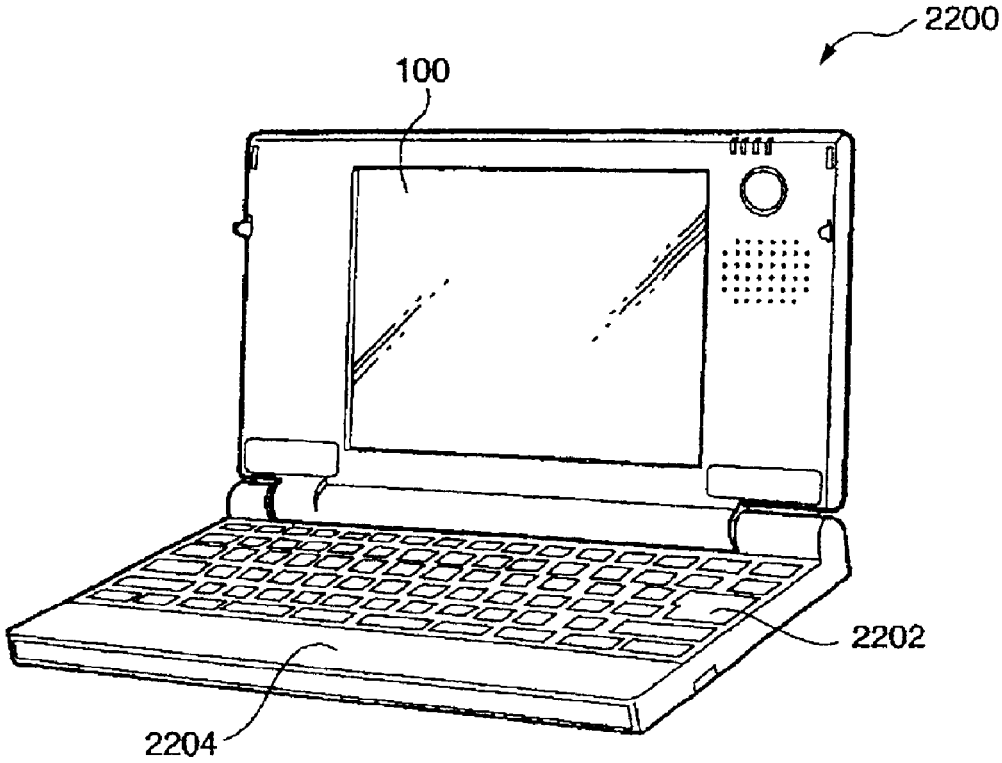

[FIG. 10]
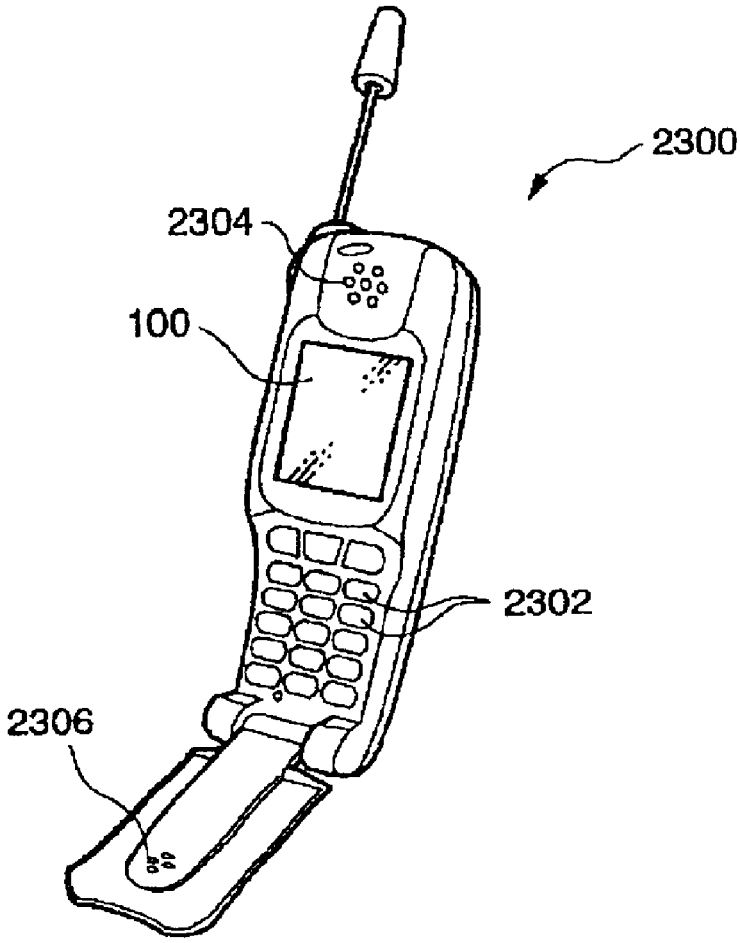

[FIG. 11]
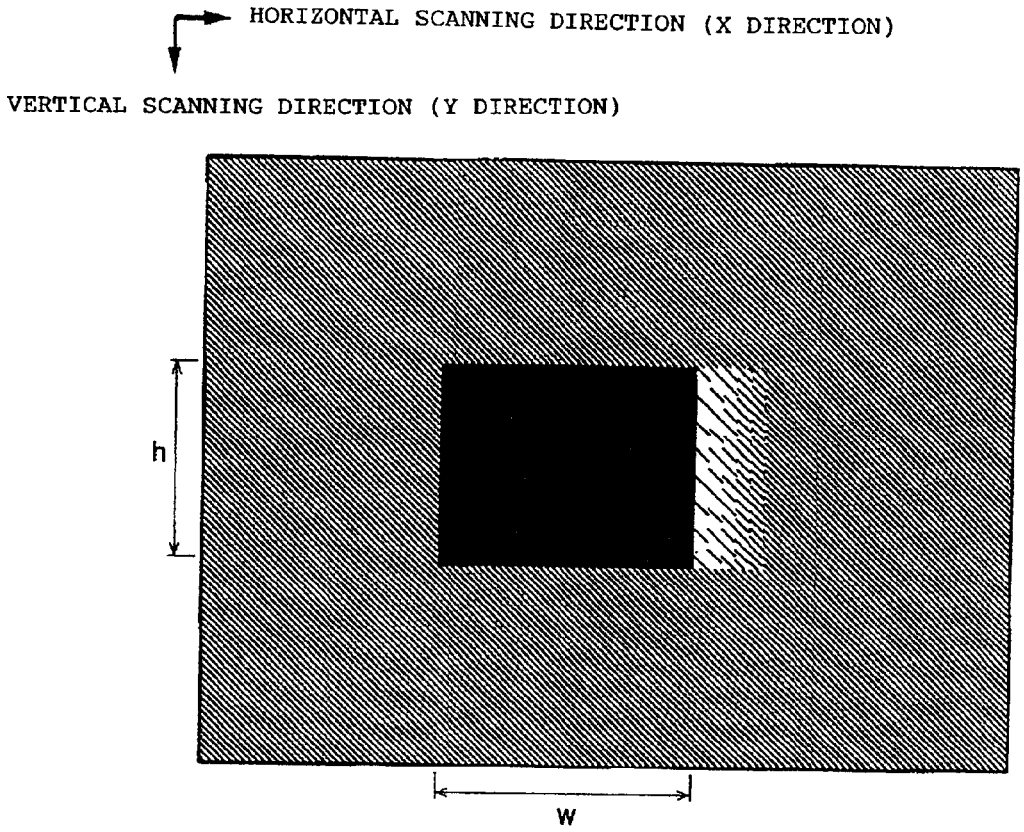

LIQUID CRYSTAL DISPLAY APPARATUS, IMAGE SIGNAL CORRECTION CIRCUIT, AND ELECTRONIC APPARATUS

BACKGROUND OF THE INVENTION

1. Field of Invention

The present invention relates to a liquid crystal display apparatus in which degradation of the display quality due to what is referred to as "horizontal crosstalk" is prevented, an image signal correction circuit therefor, and an electronic apparatus in which the liquid crystal display apparatus is used as a display unit.

2. Description of Related Art

Generally, in a liquid crystal panel, which provides a desired display using liquid crystal, the liquid crystal is held between a pair of substrates. Such liquid crystal panels can be classified into several types depending upon the driving method. For example, in an active matrix type of driving method, in which pixel electrodes are driven by three-terminal switching elements, a construction described below is provided. Of a pair of substrates constituting a liquid crystal panel, a plurality of scanning lines and a plurality of data lines are provided so as to cross each other on one of the substrates. A pair of three-terminal switching elements, such as thin-film transistors, and a pixel electrode is provided in association with each of the intersections. A peripheral circuit for driving the scanning lines and the data lines is provided in the periphery of the area where the pixel electrodes are provided (display area). On the other substrate, a transparent opposing electrode (common electrode) opposing the pixel electrodes is provided, which is maintained at a constant voltage. In addition, on the opposing surfaces of the substrates, oriented films, which have been rubbed so that the longitudinal axis of the liquid crystal molecules are gradually twisted between the substrates, for example, by approximately 90 degrees, and on the outer surfaces of the substrates, polarizers in accordance with the orientation directions are provided, respectively.

Each of the switching elements provided at the intersections of the scanning lines and the data lines is turned on when a scanning signal applied to the associated scanning line becomes active, supplying an image signal sampled by an associated data line to the pixel electrode. Thus, to the liquid crystal capacitor formed of the liquid crystal interposed between the pixel electrode and the opposing electrode, a voltage difference between the voltage on the opposing electrode and the voltage of the image signal is applied. Even if the switching element is turned off thereafter, the liquid crystal capacitor maintains the voltage difference already applied due to its own capacitance and the capacitance of a storage capacitor.

Light passing between the pixel electrode and the opposing electrode is rotary (circularly) polarized by approximately 90 degrees in accordance with a twist of the liquid crystal molecules if the difference of voltages applied to each of the substrates is zero. As the voltage difference increases, the liquid crystal molecules tend toward the direction of the electric field, and the rotary (circular) polarization is lost. Thus, for example, in the transmission type, if polarizers with orthogonal polarization axes are provided in accordance with the orientations respectively on the incident side and the rear side (in the case of the normally white mode), if the difference of voltages applied to the electrodes is zero, the light is transmitted and white is displayed (the transmissivity is large). As the difference of voltages applied to the electrodes increases, the light is blocked and finally black is displayed (the transmissivity is small). Accordingly, a desired display is provided by controlling the voltage applied to the pixel electrode on a pixel-by-pixel basis.

SUMMARY OF THE INVENTION

However, the above liquid crystal panel suffers from the problem of degradation of the display quality due to what is referred to as "horizontal crosstalk". There are several types of horizontal crosstalk. The horizontal crosstalk herein refers to the situation in which, when a black rectangle is displayed over a gray background of a predetermined gray level in the normally white mode, for example, as shown in FIG. 11, the gray area on the right (in the horizontal scanning direction) of the black area becomes brighter (or darker as the case may be) than the proper gray, and then gradually returns to the proper gray. In FIG. 11, the gray level is represented by the line gray level of oblique lines.

The present invention addresses the situation described above, and an object thereof is to provide a liquid crystal display apparatus in which, what is referred to as "horizontal crosstalk", is inhibited so as to achieve a high-quality display, an image signal correction circuit therefor, and an electronic apparatus in which the liquid crystal display apparatus is used as a display unit.

First, the cause of the horizontal crosstalk will be considered. As described above, the liquid crystal capacitor is implemented by liquid crystal disposed between the pixel electrodes and the opposing electrode. The opposing electrode is formed of transparent thin-film metal, such as ITO (Indium Tin Oxide), and has a considerable resistance. Thus, the path from the pixel electrodes to the opposing electrode functions as a kind of differentiating circuit constituted by the capacitance and the wire resistance.

In order to enhance the holding characteristics of the liquid crystal capacitor, a storage capacitor is typically provided in parallel to the liquid crystal capacitor. One end of the storage capacitor is connected to the pixel electrode, and the other end is commonly connected to a capacitor line. The capacitor line is formed of the same polysilicon of which the scanning lines are formed, and therefore has a resistive element. Thus, similarly to the opposing electrode, the path from the pixel electrode to the capacitor line functions as a type of differentiating circuit constituted by capacitance and the wire resistance.

Thus, when a switching element provided at the intersection of the scanning lines and the data lines is turned on so that an image signal corresponding to a gray level is applied to a corresponding pixel electrode, the voltage on the capacitor line changes in accordance with the direction and amount of the voltage variation of the pixel electrode, and then gradually returns to the proper voltage in accordance with the time constant thereof. The same applies to the voltage on the opposing electrode.

For the convenience of description, the normally white mode in which white is displayed when the effective voltage applied to the liquid crystal capacitor is zero will be assumed. The amount of the voltage variation at the pixel electrode increases as the gray level of the pixel approaches to black. Thus, when black, which involves the maximum amount of the voltage variation, is consecutively written to pixels, black may be written to another pixel before the opposing electrode, and the capacitor line whose voltage has changed by writing black to a pixel, returns to the proper voltage. In such an event, the voltage of the opposing electrode and the capacitor line may change before returning to the proper voltage, thus gradually deviating from the proper voltage. Even if the voltage of the opposing electrode and the capacitor line changes from the proper voltage, it will gradually return to the proper voltage if the amount of the voltage variation of the pixel electrode is small.

If the switching element connected to the pixel electrode is turned off when the voltage of the opposing electrode and the capacitor line has changed from the proper voltage, the effective voltage applied to the liquid crystal capacitor is smaller by the amount of the voltage variation of the opposing electrode and the storage capacitor, and the pixel is thus brighter (closer to white) than the proper gray level. When the switching element is turned off when the voltage of the opposing electrode and the capacitor line is at the proper voltage, the effective voltage applied to the liquid crystal capacitor will be a proper voltage.

Thus, the phenomenon shown in FIG. 11, more specifically, the phenomenon in which the gray area on the right of the black area becomes brighter than the proper gray and then gradually returns to the proper gray, occurs for the following reason. That is, in a situation where black, which involves the maximum voltage variation at the pixel electrodes, is consecutively written to pixels and then the voltage of the opposing electrode and the capacitor line is deviated from the proper voltage, when gray, which involves relatively small voltage variation at the pixel electrodes are consecutively written to pixels, the voltage of the opposing electrode and the capacitor line gradually returns to the proper voltage.

This assumption is supported by the following tendency found by research regarding the relationship between the degradation of the display quality due to horizontal crosstalk and the shape of the black area, which was performed by the inventors of the present invention. More specifically, the degradation of the display quality is not relevant to the position of the black area or the distance h of the black area in the vertical direction (vertical scanning direction). The gray area on the right of the black area becomes brighter as the horizontal distance w of the black area increases, and appears more prominently as the difference in gray level between the background gray and the black becomes larger. In other words, a longer distance w, indicating a larger number of times of consecutively writing black to pixels, increases the amount of the voltage variation of the opposing electrode and the capacitor line, and similarly, a larger difference in gray level between the background gray and the black also increases the amount of the voltage variation of the opposing electrode and the capacitor line.

According to this assumption, because the voltage of the opposing electrode and the capacitor line gradually deviates from the proper voltage as black is consecutively written to pixels, the effective voltage applied to the liquid crystal capacitor decreases from the proper value toward the right in the black area. However, the difference in the effective voltage at black pixels is not visually recognized as degradation of the display quality, because when the pixels are black (white), the gray level (transmissivity) varies little even if the effective voltage of the liquid crystal capacitor varies to an extent.

In other words, degradation of the display quality due to horizontal crosstalk is easy to visually recognize in the gray display area in which the ratio of change in gray level is large relative to the change in the effective voltage applied to the liquid crystal capacitor. However, the degradation of the display quality poses substantially no problem in the black (white) display area.

When the liquid crystal capacitor and the storage capacitor are compared, the storage capacitor has a larger capacitance. Thus, it is assumed that the effect of the voltage variation of the capacitor line is larger than that of the voltage variation of the opposing electrode on the horizontal crosstalk. Furthermore, it is assumed that, in addition to the capacitors, effect of various capacitance, such as a stray capacitance between the pixel electrodes and the data lines, is involved.

The horizontal crosstalk, which is caused by the voltage variation of the opposing electrode, the capacitor line, etc., will be prevented if the resistance of the opposing electrode and the capacitor line is kept sufficiently small. However, reducing the resistance has limitations due to restrictions of the size, process, etc. of the liquid crystal panel.

Accordingly, in this application, the deviation from the proper voltage of capacitors with one end connected to pixel electrodes, such as the opposing electrode and the capacitor line, is added to an image signal as a correction signal in advance, so that an effective voltage corresponding to the proper gray level is applied to the liquid crystal capacitor.

More specifically, according to a first aspect of this invention, the structure includes a subtractor that obtains a difference between an image signal, which is supplied in accordance with horizontal scanning and vertical scanning, and which carries information corresponding to the gray level of a pixel, and a reference signal which carries information corresponding to a predetermined gray level; an integrator that integrates the subtraction output of said subtractor on a horizontal scanning basis; an adder that adds the integration output of said integrator and an image signal corresponding thereto; a pixel electrode to which a signal corresponding to the addition output of said adder is applied in accordance with said horizontal scanning and vertical scanning; and an opposing electrode opposing said pixel electrode via liquid crystal.

In accordance with this structure, the difference between the image signal and the reference signal, i.e., the difference between the gray level represented by the image signal and the gray level represented by the reference signal is obtained, and the difference in gray level is sequentially integrated from the beginning of the horizontal scanning. Thus, the result of the integration is the value in accordance with the difference between the gray level represented by the image signal and the gray level represented by the reference signal and the period during which the difference occurred from the beginning of the horizontal scanning from the start of horizontal scanning, and thus the signal simulates the effect of the voltage variation. The signal is added to the original image signal at a coordinated timing, and then applied to the pixel electrode. Thus, a voltage at which the effect of the voltage variation of the opposing electrode, the capacitor line, etc. is cancelled at the pixel electrode. Accordingly, even if the voltage of the opposing electrode, the capacitor line, etc. changes, an effective voltage corresponding to the proper gray level is applied between the pixel electrode and the opposing electrode, preventing degradation of the display quality.

A second aspect of this invention is a correction circuit which performs a correction when an image signal is supplied to a liquid crystal panel, and more specifically, it is an image signal correction circuit, provided on the upstream of a liquid crystal panel, which displays an image in accordance with an image signal, which is supplied in accordance with horizontal scanning and vertical scanning, and which carries information corresponding to the gray level of a pixel. The image signal correction circuit includes a subtractor that obtains the difference between said image signal and a reference signal which carries information corresponding to a predetermined gray level; an integrator that integrates the subtraction output of said subtractor on a horizontal scanning basis; an adder that adds the integration output of said integrator and an image signal corresponding thereto, so that a signal corresponding to the result of the addition is supplied to said liquid crystal panel as an image signal. In accordance with this structure as well, a voltage which cancels the effect of the voltage variation of the opposing electrode, the capacitor line, etc. is added and applied to the pixel electrode, similarly preventing degradation of the display quality.

In the first and the second aspects of the invention, the reference signal preferably has a voltage which renders the gray level of the pixel gray. This is because, since the degradation of the display quality occurs in the gray display area in which the ratio of change in gray level is large relative to the change in effective voltage, as described above, it is effective to perform comparison with a voltage which renders the gray level of a pixel gray.

Furthermore, because the opposing electrode, the capacitor line, etc. return to normal state in accordance with the time constant, even if voltage variation occurs, the correction signal is preferably attenuated as time passes. Thus, the first and the second inventions preferably include an attenuation device that gradually attenuates the integration output from said integrator. This prevents excessive correction of the image signal. The attenuation device that gradually attenuates the integration result may be a construction which the integration result is attenuated at a constant rate and fed back to the input of the integrator, or the integration result may be multiplied with a coefficient which approaches zero as time passes.

An electronic apparatus according to the present invention includes the liquid crystal display apparatus as a display unit, achieving a high-quality display in which horizontal crosstalk is inhibited.

BRIEF DESCRIPTION OF THE DRAWINGS

FIG. 1 is a schematic showing the overall structure of a liquid crystal display apparatus according to an embodiment of the present invention;

FIG. 2(*a*) is a perspective view showing the external structure of a liquid crystal panel in the liquid crystal display apparatus, and FIG. 2(*b*) is a sectional view taken along plane A–A' of FIG. 2(*a*);

FIG. 3 is a schematic showing the electrical configuration of a device substrate in the liquid crystal panel;

FIG. 4 is a schematic of an image signal correction circuit in the liquid crystal display apparatus;

FIG. 5 is a timing chart for explaining the operation of the liquid crystal display apparatus;

FIG. 6 is a timing chart for explaining the operation of the liquid crystal display apparatus;

FIGS. 7(*a*) and 7(*b*) are voltage waveform charts for explaining prevention of degradation of the display quality in the liquid crystal display apparatus;

FIG. 8 is a sectional view showing the structure of a projector, which is an example of an electronic apparatus to which the liquid crystal display apparatus according to the embodiment is applied;

FIG. 9 is a perspective view of a personal computer, which is an example of an electronic apparatus to which the liquid crystal display apparatus according to the embodiment is applied;

FIG. 10 is a perspective view of a cellular phone, which is an example of an electronic apparatus to which the liquid crystal display apparatus is applied;

FIG. 11 is a plan view showing degradation of the display quality due to horizontal crosstalk.

DETAILED DESCRIPTION OF PREFERRED EMBODIMENTS

A liquid crystal display apparatus according to an embodiment of the present invention will be described below. FIG. 1 is a schematic showing the overall structure of the liquid crystal display apparatus according to the embodiment. As shown in FIG. 1, the liquid crystal display apparatus includes a liquid crystal panel 100, a control circuit 200, an image signal correction circuit 300, and a processing circuit 400. The control circuit 200 generates a timing signal, a clock signal, etc. that controls each of the components in accordance with a vertical scanning signal Vs, a horizontal scanning signal Hs, and a dot clock signal DCLK supplied from an upper-layer apparatus.

The image signal correction circuit 300 generates a correction signal which simulates the voltage variation of an opposing electrode from a digital image signal VID supplied in synchronization with the vertical scanning signal Vs, the horizontal scanning signal Hs, and the dot clock signal DCLK (i.e., in accordance with vertical scanning and horizontal scanning), and adds the correction signal to the image signal VID, outputting the result as a corrected image signal VID'. The image signal correction circuit 300 will be described later in detail.

The processing circuit 400 includes a D/A converter 402, an S/P conversion circuit 404, and an amplification and inversion circuit 406, and it processes the corrected image signal VID' corrected by the image signal correction circuit 300 into a signal which is suitable to be supplied to the liquid crystal panel 100.

The D/A converter 402 converts the corrected digital image signal VID' into an analog image signal. The S/P conversion circuit 404, upon input of an analog image signal, divides it into N (N=6 in FIG. 1) lines and extends them N-fold along the time axis (serial-parallel conversion) for output. The image signal is converted from serial to parallel in order to ensure sufficient sample and hold time and charging and discharging time by elongating the time the image signal is applied to sampling switches 151 to be described below (see FIG. 3).

The amplification and inversion circuit 406 inverts, as required, the image signals converted from serial to parallel which must be porality inverted, amplifies them as required, and supplies them to the liquid crystal panel 100 as image signals VID1 to VID6. The determination as to whether or not to invert is made in accordance with whether the data signal is applied with: 1) the polarity inverted on a scanning line basis, 2) the polarity inverted on a data line basis, or 3) the polarity inverted on a pixel basis, and the period of inversion is set to be one horizontal scanning period or one dot clock period. In this embodiment, for the convenience of description, the description will be made in relation to an example in which 1) the polarity is inverted on a scanning line basis. However, this exemplary description is not intended to limit the present invention thereto.

Furthermore, although the converted image signals VID1 to VID6 are simultaneously supplied to the liquid crystal panel 100 in this embodiment, the converted image signals VID1 to VID6 may be sequentially shifted in synchronization with the dot clock, in which case a sampling circuit, to be described below, sequentially samples the N-line image signals. The inversion of polarity in this embodiment refers to inverting the voltage level alternately between positive and negative with reference to a predetermined constant voltage Vc (the center voltage of the amplitude of the image signals and substantially equal to the voltage LCcom applied to the opposing electrode).

Although the conversion to analog is performed in the input stage of the processing circuit 400 herein, it is to be understood that the conversion to analog may be performed after the serial-parallel conversion, or after the amplification and inversion.

<Structure of the Liquid Crystal Panel>

Next, the structure of the liquid crystal panel 100 will be described. FIG. 2(*a*) is a perspective view showing the structure of the liquid crystal panel 100, and FIG. 2(*b*) is a sectional view taken along plane A–A' in FIG. 2(*a*).

As shown in FIGS. 2(*a*) and 2(*b*), in the liquid crystal panel 100, a device substrate 101 on which various elements, pixel electrodes 118, etc. are formed, and an opposing substrate 102 on which an opposing electrode, etc. are formed, are laminated with the surfaces thereof on which the electrodes are formed opposing each other, with a constant gap maintained therebetween by a sealing member 104 including spacers (not shown). The gap is filled with liquid crystal 105, for example, of the TN (Twisted Nematic) type.

Although the device substrate 101 is formed of glass, semiconductor, quartz, etc. in this embodiment, an opaque substrate may be used instead. If an opaque substrate is used as the device substrate 101, the liquid crystal panel 100 must be implemented as the reflection type instead of the transmission type. The sealing member 104 is formed along the periphery of the opposing substrate 102, with a portion thereof opened for injection of the liquid crystal 105. The opening is sealed by a sealant 106 after the liquid crystal 105 has been injected.

In an area 140*a* on the opposing surface of the device substrate 101 and on one side of the outside of the sealing member 104, a data line driving circuit 140 is formed, and in an area 150*a* inside it, a sampling circuit 150 is formed. On the peripheral portion associated with the one side, a plurality of mounting terminals 107 is formed, allowing input of various signals from the control circuit 200, the processing circuit 400, etc.

In areas 130*a* associated with two sides adjacent to the one side, scanning line driving circuits 130 are formed respectively, so that the scanning lines will be driven from both sides. If a delay of a scanning signal supplied to the scanning lines can be tolerated, only one scanning line driving circuit 130 may be formed on one side. Furthermore, in an area 160*a* associated with the remaining side, wiring (not shown), which is shared by the two scanning line driving circuits 130, and a precharge circuit 160, to be described below, are formed.

The opposing electrode 108 provided on the opposing substrate 102 is electrically connected to the mounting terminals 107 formed on the device substrate 101 via a conductor formed of silver paste, etc. provided on at least one of the four corners of the portion laminated with the device substrate 101, so that the constant voltage LCcom will be applied thereto.

Typically, the opposing substrate 108 is not patterned, and instead is formed fully over the opposing substrate 102, thus opposing not only pixel electrodes 118 but also other portions of the device substrate 101. Furthermore, because the opposing electrode 108 is formed of transparent thin-film metal, such as ITO as described above, the wire resistance thereof is relatively large. Thus, the opposing electrode 108 is actually susceptible to voltage variation due to the effects of each of the components on the device substrate 101, particularly, image signal lines, the data lines, etc.

In addition, on the opposing substrate 102, although not shown, colored layers (color filters) are provided as required in areas opposing the pixel electrodes 118. If the application is modulation of colored rays as in a projector to be described below, the colored layers need not be provided on the opposing substrate 102. Furthermore, irrespective of whether the colored layers are provided, light blocking films (not shown) are formed in the portions not opposing the pixel electrodes 118 in order to prevent degradation of contrast ratio due to leakage of light.

Furthermore, on the opposing surfaces of the device substrate 101 and the opposing substrate 102, oriented films, which have been rubbed so that the longitudinal axis of the molecules of the liquid crystal 105 continuously twists by approximately 90 degrees between the substrates, are provided, and on the outer surfaces thereof, polarizers in accordance with the orientation directions are respectively provided. The oriented films and the polarizers are not directly relevant to the present invention and are therefore not shown in the figures. In FIG. 2(*b*), the opposing electrode 108, the pixel electrodes 118, the mounting terminals 107, etc. are shown with thickness only for the convenience of illustrating the positions thereof, and the thickness is negligibly small compared with the thickness of the substrates.

<Device Substrate>

Next, the electrical configuration of the device substrate 101 in the liquid crystal panel 100 will be described. FIG. 3 is a schematic showing the structure of the device substrate 101.

As shown in FIG. 3, in the display area of the device substrate 101, a plurality of scanning lines 112 is formed in parallel along the row (X) direction, and a plurality of data lines 114 is formed in parallel along the column (Y) direction. At each of the intersections of the scanning lines 112 and the data lines 114, the gate of a thin film transistor (hereinafter referred to as a TFT) 116, which serves as a switching element to control a pixel, is connected to a scanning line 112, the source of the TFT 116 is connected to a data line 114, and the drain of the TFT 116 is connected to a rectangular transparent pixel electrode 118.

As described above, in the liquid crystal panel 100, the liquid crystal 105 is disposed between the surfaces of the device substrate 101 and the opposing substrate 102 on which the electrodes are formed, the liquid crystal capacitance at each of the pixels is thus formed by the pixel electrode 118, the opposing electrode 108, and the liquid crystal 105 disposed between the electrodes. For convenience of description, let the number of the scanning lines 112 be "m" and the total number of the data lines 114 be "6n" (m and n each being an integer), the pixels being arranged in an m×6n matrix corresponding to the intersections of the scanning lines 112 and the data lines 114.

Furthermore, in the display area formed of the matrix of pixels, a storage capacitor 119 is provided for each of the pixels in order to prevent leakage from the liquid crystal capacitance. One end of the storage capacitor 119 is connected to the pixel electrode 118 (the drain of the TFT 116), and the other end thereof is connected to a common capacitor line 175. In this embodiment, the capacitor line 175 is grounded to a constant voltage (e.g., the voltage LCcom, the high-side or low-side power supply voltage of a driving circuit, etc.) via the connecting terminals 107.

In the non-display area of the device substrate 101, a peripheral circuit 120 is formed. The peripheral circuit is conceptualized as circuitry including the scanning line driving circuits 130, the data line driving circuit 140, the sampling circuit 150, the precharge circuit 160, and a testing circuit to test for defects after manufacturing, among which the testing circuit is not directly relevant to the present invention and the description thereof will therefore be omitted.

The components of the peripheral circuit 120 are manufactured by a manufacturing process common to the TFTs 116 that drive the pixels. It is advantageous in order to reduce the overall size of the apparatus and reduce costs to incorporate the peripheral circuit 120 in the device substrate 101, and to form the components by the common process, compared with the type in which the peripheral circuit 120 is formed on a separate substrate and attached externally.

In the peripheral circuit 120, the scanning line driving circuits 130 output, within one vertical effective display period, scanning signals G1, G2, . . . , and Gm, which sequentially become active in each one horizontal scanning period 1H. The details thereof are not directly relevant to the present invention and are therefore not shown in FIG. 3. The scanning line driving circuits 130 are each formed of a shift register and a plurality of AND circuits. As shown in FIG. 5, the shift register sequentially shifts a transfer start pulse DY supplied at the beginning of a vertical scanning each time the level of the clock signal CLY alternates (both at the rise and at the fall), outputting signals G1', G2', G3', and Gm', and each of the AND circuits obtains an AND signal of adjacent ones of the signals G1', G2', G3', . . . , and Gm', outputting signals G1, G2, G3, . . . , and Gm.

The data line driving circuit 140 outputs sampling signals S1, S2, . . . , and Sn which sequentially become active within a horizontal effective display period. The details thereof are not directly relevant to the present invention and therefore are not shown in FIG. 3. The data line driving circuit 140 is formed of a shift register and a plurality of AND circuits. As shown in FIGS. 5 and 6, the shift register sequentially shifts a transfer start pulse DX supplied at the beginning of horizontal effective display period each time the level of the clock signal CLX alternates, outputting signals S1', S2', S3', . . . and Sn', and each of the AND circuits shortens the pulse width of the signals S1', S2', S3', . . . , and Sn' to a period SMPa while avoiding overlap of adjacent signals, outputting sampling signals S1, S2, S3, . . . , and Sn.

Next, the sampling circuit 150 samples the image signals VID1 to VID6 supplied via six image signal lines 171 to each of the data lines 114 in accordance with the sampling signals S1, S2, S3, . . . , Sn, and it is formed of sampling switches 151 provided for each of the data lines 114.

The data lines 114 are grouped into blocks by the unit of six lines. Referring to FIG. 3, of the six data lines 114, which belong to the ith (i=1, 2, . . . , n) block, the sampling switch 151 connected to one end of the leftmost data line 114 samples the image signal VID1 supplied via the image signal line 171 in the period when the sampling signal Si is active, and supplies it to the data line 114. Also, of the six data lines 114, which belong to the ith block, the sampling switch 151, which is connected to one end of the second data line 114, samples the image signal VID2 in the period when the sampling signal Si is active, and supplies it to the data line 114. Similarly, of the six data lines 114 which belong to the ith block, each of the sampling switches 151 connected to one end of the third, fourth, fifth, and sixth data line 114 samples each of the image signals VID3, VID4, VID5, and VID6 in a period when the sampling signal Si is active, and supplies it to the corresponding data line 114.

The sampling switch 151 is implemented by an N-channel TFT in this embodiment. Thus, when the sampling signals S1, S2, . . . , and Sn go to H level, the corresponding sampling switch 151 is turned on. The sampling switch 151 may be implemented by a P-channel TFT, or a complementary TFT in which N-channel and P-channel are combined.

In an area opposite to the data line driving circuit 140 with respect to the display area, the precharge circuit 160 is provided. The precharge circuit 160 is formed of precharging switches 161 provided for each of the data lines 114. Each of the precharging switches 161 precharges a precharge voltage signal PS supplied, via a precharge signal line 179, to the data line 114 when a precharge control signal PG supplied, via precharge control lines 177, becomes active.

As shown in FIG. 6, the precharge control signal PG is active in retrace periods between horizontal effective display periods, more specifically, during a period separated from the temporal leading and trailing edges thereof. Furthermore, as shown in FIG. 6, for example, the precharge voltage signal PS is inverted between the voltages Vg+ and Vg− with reference to the voltage Vc on each half cycle of the clock signal CLY (one horizontal scanning period).

As described above, the voltage Vc is the center amplitude voltage of the image signals VID1 to VID6 and is substantially equal to the voltage LCcom, which is applied to the opposing electrode 108. The voltages Vg+ and Vg− are, respectively, higher and lower than the voltage Vc, and each of the voltages corresponds to gray. The precharge voltage signal PS is not limited to a voltage corresponding to gray. The voltages Vb+ and Vb− correspond to black respectively in the positive side and the negative side assuming that the normally white mode, in which white is displayed with no voltage applied, is employed in this embodiment.

In the precharge circuit 160, in the retrace period immediately before the horizontal effective display period in which the sampling signals S1, S2, S3, . . . , and Sn are supplied, each of the data lines 114 is precharged to the voltage Vg+ or Vg−, thus reducing the load when the image signals VID1 to VID6 are sampled to the data lines 114 in the immediately following horizontal effective display period.

Although only one scanning line driving circuit 130 is shown on one side of the scanning lines 112 in FIG. 3 for the convenience of illustrating the electrical configuration, two scanning line driving circuits 130 are actually provided on both sides the scanning lines 112 as shown in FIG. 2.

<Details of the Image Signal Correction Circuit>

Next, the image signal correction circuit 300 will be described in detail. FIG. 4 is a schematic showing the structure of the image signal correction circuit 300. Referring to FIG. 4, the image signal VID is a digital signal carrying information corresponding to the gray level of a pixel, supplied from an upper-later apparatus in synchronizing with vertical scanning and horizontal scanning, as described above.

A subtractor 302 subtracts a reference signal Ref from the image signal VID. The reference signal Ref carries information corresponding to a predetermined gray level, and in this embodiment, it carries information corresponding to gray which readily allows visual recognition of degradation of the display quality. A multiplier 304 multiplies the result of the subtraction by the subtractor 302 with an adjusting coefficient k1. A subtractor 306 subtracts the result of the multiplication by a multiplier 310 from the result of the multiplication by the multiplier 304.

An integrator 308 integrates the result of the subtraction by the subtractor 306 after a reset in response to a transfer start pulse DX. The multiplier 310 multiplies the result of the integration by the integrator 308 with a coefficient k2 greater than or equal to 0 and less than or equal to 1. A multiplier 312 multiplies the result of the integration by the integrator 308 with an adjusting coefficient k3, outputting a correction signal Igr.

A delaying unit 316 delays the image signal VID for the time required for the operations from the subtractor 302 to the multiplier 312. The delay time is assumed to be one cycle of the dot clock DCLK in this embodiment for the convenience of description. An adder 314 adds the correction signal Igr to the image signal VID delayed in accordance with the correction signal Igr, outputting a corrected image signal VID'.

In accordance with this structure, assuming that the multiplier 310 is not present, the correction signal Igr corresponds to the accumulated value of the difference between the image signal VID and the reference signal Ref from the start of the horizontal effective display period. For example, if writing is performed with a positive voltage in the normally white mode, if the gray level of the pixel, represented by the image signal VID, corresponds to black, the difference obtained by subtracting the reference signal Ref from the image signal VID is positive. Thus, the correction signal Igr has a larger positive value as the difference in gray level between the black and the gray represented by the reference signal increases and as the horizontal scanning period for the black pixel increases.

Actually, however, because the result of the integration by the integrator 308 is fed back via the multiplier 310 and the subtractor 306, if the image signal VID changes with the difference in gray level with the reference signal Ref being constant, the ratio of change in the result of the integration by the integrator 308 gradually decreases, and accordingly, the correction signal Igr also increases and decreases with the ratio of change thereof gradually decreasing.

<Operation of the Liquid Crystal Display Apparatus>

Next, the operation of the liquid crystal display apparatus having the structure described above will be described. First, to the scanning line driving circuits 130, a transfer start pulse DY is supplied at the beginning of a vertical effective display period. As shown in FIG. 5, the transfer start pulse DY is sequentially shifted each time the level of the clock signal CLY alternates, whereby signals G1', G2', G3', . . . , and Gm' are output. Then, AND signals of the adjacent ones of the signals G1', G2', G3', . . . , and Gm' are obtained and output to the corresponding scanning lines 112 as scanning signals G1, G2, G3, . . . , and Gm which become active on each one horizontal scanning period 1H.

First, a horizontal scanning period 1H in which the scanning signal G1 is active will be considered. Assuming that writing is performed with a positive voltage in the horizontal scanning period 1H for the convenience of description, the image signals VID1 to VID6 output from the S/P conversion circuit 404 (see FIG. 1) are higher than the voltage LCcom (more strictly, the voltage Vc) applied to the opposing electrode 108.

Furthermore, prior thereto, the precharge control signal PG becomes active in a period separated from the leading and trailing edges of the retrace period, as shown in FIG. 6. At this time, the precharge voltage signal PS is the voltage Vg+ corresponding to the writing with a positive voltage. Thus, all the data lines 114 are precharged to the voltage Vg+ in the period.

Next, when the retrace period is complete and a horizontal effective display period is entered, a transfer start pulse DX is supplied to the data line driving circuit 140 at the beginning thereof, as shown in FIGS. 5 and 6. The transfer start pulse DX is sequentially shifted each time the level of the clock signal CLX alternates, whereby signals S1', S2', S3', and Sn' are output. The pulse width of each of the signals S1', S2', S3', . . . and Sn' are shortened to the period SMPa while avoiding overlap of adjacent signals, whereby sampling signals S1, S2, S3, . . . , and Sn are output.

The image signal VID input to the image signal correction circuit 300 is delayed by the delaying unit 316 for one cycle of the dot clock DCLK, and the correction signal Igr which simulates the voltage variation of the opposing electrode 108 is added thereto, whereby the corrected image signal VID' is output.

Furthermore, the corrected image signal VID' is first converted to an analog signal by the D/A conversion circuit 402, second divided into the image signals VID1 to VID6 and extended sixfold along the time axis by the S/P conversion circuit 402, third amplified and inverted as required by the amplification and inversion circuit 406, and then supplied to the liquid crystal panel 100.

In the period in which the scanning signal G1 is active, when the sampling signal S1 becomes active, the image signals VID1 to VID6 are sampled respectively to the six data lines 114 which belong to the leftmost block. The image signals VID1 to VID6, which have been sampled, are respectively applied to the corresponding pixel electrodes 118 by the TFTs 116 of the pixels at the intersections of the six data lines 114 and the uppermost scanning line 112 in FIG. 3.

Then, when the sampling signal S2 goes active, the image signals VID1 to VID6 are sampled respectively to the six data lines 114 which belong to the second block, and the image signals VID1 to VID6 are applied to the corresponding pixel electrodes 118 by the TFTs 116 of the pixels at the intersections of the six data lines 114 and the uppermost scanning line 112.

Similarly, when the sampling signals S3, S4, . . . , and Sn sequentially become active, the image signals VID1 to VID6 are sampled respectively to the six data lines which belong to the third, fourth, . . . , and nth block, and the image signals VID1 to VID6 are applied to the corresponding pixel electrodes 118 by the TFTs 116 of the pixels at the intersections of the six data lines 114 and the uppermost scanning line 112. Writing to all the pixels on the uppermost row is thus completed.

Next, the period in which the scanning signal G2 becomes active will be described. As described above, in this embodiment, the polarity is reversed on a scanning line basis. Thus, in this horizontal scanning period, writing is performed with a negative voltage. Therefore, the image signals VID1 to VID6 output from the S/P conversion circuit 402 are lower than the voltage LCcom (more strictly, the voltage Vc) applied to the opposing electrode 108. Prior thereto, the precharge voltage signal VS in the retrace period is Vg−. Thus, when the precharge control signal PG goes active, all the data lines 114 are precharged to the voltage Vg−.

The operation is otherwise the same, and the sampling signals S1, S2, S3, . . . , and Sn sequentially become active, whereby writing to all the pixels on the second row is completed.

Similarly, the scanning signals G3, G4, . . . , and Gm become active, whereby writing to the pixels on the third, fourth, . . . , and mth row is performed. Thus, writing to the pixels on the odd rows is performed with a positive voltage while writing to the pixels on the even rows are performed with a negative voltage, and writing to the pixels on all the first to mth rows is completed in the vertical scanning period.

Similar writing is performed in the next vertical scanning period, but with a reversed polarity for the pixels on each of the rows. That is, in the next vertical scanning period, writing to the pixels on the odd rows is performed with a negative voltage, while writing to the pixels on the even rows is performed with a positive voltage. Because the polarity for the writing to the pixels is reversed on a vertical scanning period basis, direct current component is not applied to the liquid crystal 105, preventing degradation thereof.

In accordance with this type of driving method, compared with the method in which the data lines 114 are driven one by one, the time to sample the image signals by the sampling switches 151 becomes sixfold, providing sufficient time to charge and discharge at the pixels, and thereby serving to enhance contrast. Furthermore, the number of the stages of the shift register in the data line driving circuit 140, and the frequency of the clock signal CLX are reduced to one sixth, serving to reduce power consumption as well as the number of stages.

Furthermore, the active period of each of the sampling signals S1, S2, . . . , and Sn is made shorter than a half cycle of the clock signal CLX and is limited to the period SMPa, preventing overlap of adjacent sampling signals. Thus, the image signals VID1 to VID6 to be sampled to the six data lines 114 which belong to a block is prevented from being simultaneously sampled to the six data lines 114 which belong to an adjacent block, achieving a high-quality display.

When a black rectangle is displayed over a gray background, as shown in FIG. 11, when the black area is horizontally scanned, the image signal VID maintains gray from the start of the horizontal effective display period, turns to black at the timing t1, and returns to gray at the timing t2, as shown in FIG. 7(*a*). When the image signal VID returns to gray at the timing t2, the voltage to the opposing electrode 108 (also on the capacitor line 175) is deviated to the black side. Thus, the right portion of the black area becomes brighter than the proper gray, causing degradation of the display quality, as shown in FIG. 11.

In this embodiment, when the image signal VID, shown in FIG. 7(*a*), is input to the image signal correction circuit 300, the difference in gray level with the reference signal Ref is zero until the timing t1, and the correction signal Igr is thus maintained to be zero. Next, the correction signal Igr start increasing at the timing t1 at which the image signal VID changes to black, but the ratio of change gradually decreases because the result of the integration by the integrator 308 is fed back by the multiplier 310 and the subtractor 306 as described above. After the timing t2 at which the image signal VID changes to gray, the difference in gray level with the reference signal Ref again becomes zero, and the result of the integration decreases due to the feed back, the correction signal Igr thus gradually converging and returning to zero.

Then, the corrected image signal VID', obtained by adding the correction signal Igr to the image signal VID, is added with the voltage variation of the opposing electrode 108 (the capacitor line 175), as shown in FIG. 7(*b*), and supplied to the liquid crystal panel 100 via the processing circuit 400.

Thus, in this embodiment, when the black area, shown in FIG. 11, is horizontally scanned, even if the opposing electrode 108 (the capacitor line 175) has a voltage variation at the timing t2, the voltage variation is added to the image signal VID and applied to the pixel electrode 118. Thus a voltage Vg corresponding to the proper gray is applied to the liquid crystal capacitor of the pixels disposed on the right of the black area. Accordingly, this embodiment prevents the degradation of the display quality, as shown in FIG. 11.

Furthermore, even if the correction signal Igr has a certain value at a timing, when the difference in gray level between the image signal VID and the reference signal Ref is eliminated, the correction signal Igr gradually converges to zero as time passes. Thus, the voltage variation on the opposing electrode 108 and the capacitor line 175 is appropriately simulated, inhibiting excessive correction.

<Miscellaneous>

Although, in the above-described embodiment, six data lines 114 are grouped into one block, so that the image signals VID1 to VID6 converted into six lines are sampled to the six data lines 114, which belong to the block, the number of the image signals and the number of lines to which signals are simultaneously applied (i.e., the number of data lines constituting one block) is not limited to six. For example, if the response of the sampling switches 151 in the sampling circuit 150 is sufficiently quick, the corrected image signal may be serially transmitted to one image signal line without converting it to parallel and sequentially sampled for each of the data lines 114. Furthermore, the number of the image signals, and the number of the lines to which the signals are applied simultaneously, may be 3, 12, 24, etc., so that corrected image signals of 3, 12, 24, etc. lines are simultaneously supplied to 3, 12, 24, etc. data lines. Because a color image signal is formed of signals associated with three primary colors, the number of the image signals is preferably a multiple of three to facilitate control and circuit. However, if the application is simply light modulation as in a projector to be described below, it need not be a multiple of three.

Although the image signal correction circuit 300 processes the digital image signal VID in the above-described embodiment, it may process an analog image signal, in which case the voltage of the image signal represents the gray level of the pixel. Furthermore, although the image signal correction circuit 300 performs correction before the serial-parallel conversion of the image signal, it may perform correction after the serial-parallel conversion, or the serial-parallel conversion may be eliminated, as described above.

Furthermore, the embodiment has been described in the context of the normally white mode, in which white is displayed when the voltage difference between the opposing electrode 108 and the pixel electrode 118 is zero, the normally black mode, in which black is displayed, may be employed. Furthermore, although the voltages Vg+ and Vg− corresponding to gray are selected as the precharge voltage PS, the level being inverted on a horizontal scanning line period basis in accordance with the polarity of writing, as shown by a dashed line in FIG. 6, a voltage Vw corresponding to white may be selected so that the precharge voltage is constant over time, voltages Vb+ and Vb− corresponding to black may be selected so that the polarity is inverted on a horizontal scanning line period basis, or voltages corresponding to different densities may be selected in accordance with the polarity of writing.

In addition, although glass substrate is used as the device substrate 101, using the SOI (Silicon On Insulator)

technique, a silicon monocrystalline film may be formed on an insulative substrate formed of sapphire, quartz, glass, etc. so that various elements are formed thereon. Also, a silicon substrate may be used as the device substrate 101, various elements being formed thereon. In this case, field-effect transistors may be used as various switches, facilitating high-speed operation. However, if the device substrate is not transparent, the liquid crystal display apparatus must be used as the reflection type by forming the pixel electrodes 118 with aluminum or separately forming a reflection layer, etc.

Furthermore, although TN liquid crystal is used in the above-described embodiment, bi-stable type having a memory capability, such as BTN (Bistable Twisted Nematic) type and ferroelectric type, polymer dispersion type, and GH (Guest Host) type, in which a dye (guest), having anisotropy to absorption of visible light in the longitudinal axis direction and the lateral direction of the molecule, is dissolved into liquid crystal (host) having a regular molecular arrangement so that the dye molecules and the liquid crystal molecules are arranged in parallel, may be used.

Furthermore, a vertical orientation (homeotropic orientation), in which the liquid crystal molecules are aligned vertically to the substrate when no voltage is applied, and the liquid crystal molecules are aligned horizontally to the substrates when a voltage is applied may employed, or a parallel (horizontal) orientation (homogeneous orientation), in which the liquid crystal molecules are aligned horizontally to the substrates when no voltage is applied, and the liquid crystal molecules are aligned vertically to the substrates when a voltage is applied, may be employed. Thus, the present invention may be applied to various types of liquid crystals and various orientation methods.

<Electronic Apparatus>

Next, several electronic apparatuses incorporating the liquid crystal display apparatus according to the above-described embodiment will be described.

<1. Projector>

First, a projector, in which the liquid crystal display apparatus described above is used as a light bulb will be described. FIG. 8 is a plan view showing the structure of the projector. As shown in FIG. 8, inside the projector 2100, a lamp unit 2102 having a white light source, such as a halogen lamp, is provided. Light emitted from the lamp unit 2102 is separated into the three primary colors, R (red), G (green), and B (blue), by three mirrors 2106 and two dichroic mirrors 2108 internally disposed, and respectively guided to light bulbs 100R, 100G, and 100B corresponding to the primary colors. Because the B color light has a longer light path compared with the R color and the G color, in order to prevent loss, it is transmitted via a relay lens system 2121 including an incident lens 2122, a relay lens 2123, and an outputting lens 2124.

The structure of the light bulbs 100R, 100G, and 100B is identical to that of the liquid crystal panel 100 in the above-described embodiment, and the light bulbs are respectively driven by image signals corresponding to the colors of R, G, and B, supplied from the processing circuit (not shown in FIG. 8). That is, the projector 2100 includes three sets of the liquid crystal display apparatus, shown in FIG. 1, corresponding to the colors of R, G, and B.

Light modulated by the light bulbs 100R, 100G, and 100B is incident on the dichroic prism 2112 from three directions. At the dichroic prism 2112, the R color and B color lights are bent by 90 degrees while G color light passes straightforward. Thus, after an image formed of the colors is formed, the color image is projected onto the screen 2120 by a projection lens 2114.

Because light corresponding to the primary colors R, G, and B are incident on the light bulbs 100R, 100G, and 100B by the dichroic mirrors 2108, color filters described above need not be provided. The images transmitted by the light bulbs 100R and 100B are reflected by the dichroic mirrors 2112 and then projected, while the image transmitted by the light bulb 100G is directly projected. Thus, the horizontal scanning by the light bulbs 100R and 100B is performed in the opposite direction from the horizontal scanning by the light bulb 100G, so that an image, in which right and left is inverted, is displayed.

<2. Mobile Computer>

Next, an example in which the liquid crystal display apparatus according to the above-described embodiment is applied to a mobile personal computer will be described. FIG. 9 is a perspective view showing the structure of the personal computer. Referring to FIG. 9, the computer 2200 includes a main unit 2204 provided with a keyboard 2202, and a liquid crystal panel 100 used as a display unit. On the rear face thereof, a backlight unit (not shown) for enhancing visibility is provided.

<3. Cellular Phone>

Next, an example in which the liquid crystal display apparatus described above is applied to a display unit of a cellular phone will be described. FIG. 10 is a perspective view showing the structure of the cellular phone. Referring to FIG. 9, the cellular phone 2300 includes a plurality of operation buttons 2302, a mouthpiece 2304, an earpiece 2306, and a liquid crystal panel 100 used as the display unit. On the rear face of the liquid crystal panel 100, a backlight unit (not shown) for enhancing visibility is provided.

<Summary of Electronic Apparatuses>

In addition to those described with reference to FIGS. 8, 9, and 10, the electronic apparatuses may include a television set, a video tap recorder of the view finder type or the monitor direct viewing type, a car navigation apparatus, a pager, an electronic notebook, a pocket calculator, a word processor, a workstation, a television phone, a POS terminal, a digital still camera, a device provided with a touch panel, etc. It is to be understood that the liquid crystal display apparatus according to the present invention may be applied to various electronic apparatuses, whether or not specifically identified above or even later developed.

As described above, according to the present invention, because a correction signal which simulates the voltage variation of an opposing electrodes and a capacitor line is added to an original image signal and then applied to pixel electrodes, even if voltage variations occur, an effective voltage corresponding to the proper gray level is applied between the pixel electrodes and the opposing electrode. Accordingly, degradation of the display quality is prevented.

What is claimed is:

1. A liquid crystal display apparatus, comprising:

a subtractor that obtains a difference for a pixel in the liquid crystal display between an image signal, which is supplied in accordance with horizontal scanning and vertical scanning, and which carries information corresponding to gray level of a pixel and a reference signal carrying information corresponding to a predetermined gray level;

an integrator that integrates a subtraction output of said subtractor on a horizontal scanning basis;

an adder that adds an integration output of said integrator and an image signal corresponding thereto;

a pixel electrode, to which a signal corresponding to an addition output of said adder, is applied in accordance with said horizontal scanning and said vertical scanning;

liquid crystal; and an opposing electrode opposing said pixel electrode via the liquid crystal.

2. The liquid crystal display apparatus according to claim 1, said reference signal carrying information corresponding to a transmissivity in between a transmissivity of a white display and a transmissivity of a black display.

3. The liquid crystal display apparatus according to claim 1, further comprising an attenuation device that gradually attenuates the integration output of said integrator.

4. The liquid crystal display apparatus according to claim 1, said liquid crystal display apparatus employing a normally white mode.

5. An image signal correction circuit which is provided upstream of a liquid crystal panel which displays an image in accordance with an image signal, which is supplied in accordance with horizontal scanning and vertical scanning, and which carries information corresponding to a gray level of a pixel, said image signal correction circuit comprising:

a subtractor that obtains a difference for a pixel in the liquid crystal panel between said image signal and a reference signal which carries information corresponding to a predetermined gray level;

an integrator that integrates a subtraction output of said subtractor on a horizontal scanning basis;

an adder that adds an integration output of said integrator and an image signal corresponding thereto, a signal corresponding to a result of addition of the adder being supplied to said liquid crystal panel as an image signal.

6. The image signal correction circuit according to claim 5, said reference signal carrying information corresponding to a transmissivity in between a transmissivity of a white display and a transmissivity of a black display.

7. The image signal correction circuit according to claim 5, further comprising an attenuation device that gradually attenuates an integration output of said integrator.

8. An electronic apparatus, comprising:

a liquid crystal display apparatus according to claim 1 as a display unit.

9. A method for driving a liquid crystal display apparatus including a pixel electrode and an opposing electrode opposing said pixel electrode through the liquid crystal, the method comprising:

determining a difference for a pixel in the liquid crystal display between an image signal and a reference signal, the image signal being supplied in accordance with horizontal scanning and vertical scanning and carrying information corresponding to gray level of pixel, the reference signal carrying information corresponding to a predetermined gray level;

integrating the difference between said image signal and said reference signal on a horizontal scanning basis;

adding the integrated difference to said image signal; and supplying a sum of the integrated difference and said image signal to said pixel electrode in accordance with said horizontal scanning and said vertical scanning.

10. A method for correcting an image signal, which is for displaying on a liquid crystal panel and which is supplied in accordance with horizontal scanning and vertical scanning, said image signal correction method comprising:

determining a difference for a pixel in the liquid crystal panel between said image signal and a reference signal which carries information corresponding to a predetermined gray level;

integrating the difference between said image signal and said reference signal on a horizontal scanning basis; and supplying a sum of the integrated difference and said image signal to said liquid crystal panel as an image signal.

* * * * *